United States Patent [19]

Fuhrmann et al.

[11] Patent Number: 4,958,564

[45] Date of Patent: Sep. 25, 1990

[54] METHOD AND SYSTEM FOR PREPARING A PLANOGRAPHIC PRINTING FORM

[75] Inventors: Hartmut Fuhrmann, Karlsfeld; Reinhard Plaschka, Neuried, both of Fed. Rep. of Germany

[73] Assignee: Man Roland Druckmaschine AG, Offenbach am Main, Fed. Rep. of Germany

[21] Appl. No.: 417,299

[22] Filed: Oct. 5, 1989

[30] Foreign Application Priority Data

Oct. 8, 1988 [DE] Fed. Rep. of Germany ..... 3834270

[51] Int. Cl.[5] ..... B41C 1/05; B41C 1/10

[52] U.S. Cl. ..... 101/467

[58] Field of Search ..... 101/467, 470

[56] References Cited

U.S. PATENT DOCUMENTS

| | | | |
|---|---|---|---|
| 3,859,920 | 1/1975 | Ritzerfeld | 101/467 |
| 3,964,389 | 6/1976 | Peterson | 101/467 |
| 4,846,065 | 7/1989 | Mayrhofer et al. | 101/467 X |

FOREIGN PATENT DOCUMENTS

| | | | |
|---|---|---|---|
| 0264604 | 4/1988 | European Pat. Off. . | |
| 3636129 | 5/1988 | Fed. Rep. of Germany . | |
| 39457 | 3/1983 | Japan | 101/467 |
| 264953 | 11/1987 | Japan | 101/467 |

*Primary Examiner*—Clifford D. Crowder

*Attorney, Agent, or Firm*—Frishauf, Holtz, Goodman & Woodward

[57] ABSTRACT

To prevent engagement of a thermo printing head (23), with a thermo transfer tape (22) directly against a plate cylinder having an unyielding surface, an auxiliary transfer element in ribbon, tape or belt form (24, 24', 35) is provided, which is engaged against the thermo tape, ribbon or belt (22) by a counter roller (25) of yielding material or have a yielding surface; thermally affectable material is transferred from the thermo transfer tape in accordance with image information to be printed on the auxiliary tape (24, 24') for transfer to the plate cylinder or material which is not to print is transferred on the auxiliary tape, and the remainder of the material is transferred from the thermo transfer tape on the tape cylinder (10).

14 Claims, 2 Drawing Sheets

METHOD AND SYSTEM FOR PREPARING A PLANOGRAPHIC PRINTING FORM

Reference to related publication: U.S. Pat. No. 4,846,065, to which German Pat. No. 36 36 128 corresponds.

FIELD OF THE INVENTION

The present invention relates to a method and a system to prepare a planographic printing form for planographic printing, in which hydrophilic and hydrophobic regions, corresponding to a printing image, are transferred to the printing form by means of heat and/or pressure from a transfer element, such as a tape or the like.

BACKGROUND

It has previously been proposed to transfer oleophilic surface elements from a thermal transfer tape unto a hydrophilic surface of a printing form, see U.S. Pat. No. 4,846,065. A control element controls the thermal transfer tape to provide thereon selected areas of thermally affectable material, the material being hydrophobic, but ink-accepting. A control element or control system is provided to generate heat, in point-by-point form, so that individual individual ink-accepting dots, can be transferred to the surface of the printing form. To provide for sharpness of character representation, and to obtain a clear limit and boundary of the regions which are transferred, it has been proposed to so construct the printing form that at least the surface thereof has a heat insulating material. This prevents rapid dissipation of the heat generated by the thermal printing head and ensures a precisely delimited sharp transfer of the thermo transfer layer on the thermo transfer tape.

The printing form is comparatively stiff and, upon transfer of incremental surface areas, the heat contact may be insufficient for sharp transfer of thermo affectable material. Flat printing forms are generally rigid and, upon control of a thermo transfer tape by a linear thermal print head, extending, for example, for a considerable length length on the printing form, it may be difficult to so fit and match the printing head, the thermo tape and the printing form against each other that the heat contact throughout the entire length of the printing head and the printing form is sufficient and appropriate for excellent transfer of the thermally affectable material.

THE INVENTION

It is an object to improve transfer of an image to a printing form by thermally affectable material in which excellent transfer of the material to the printing form is ensured.

Briefly, transfer is carried out by use of an auxiliary transfer element, for example in tape form. The auxiliary transfer element is somewhat yieldable or flexible transversely to its thickness so that heat transfer from the thermo transfer element, for example also in tape form, to the auxiliary transfer element can be readily carried out. The auxiliary transfer element, then, can be contacted against the printing form for transferring those portions of the thermally affectable which it has received to the printing form; or, in another form, which might be formed a negative transfer, the material which is transferred to the auxiliary transfer element remains thereon and the remainder of the thermo transfer tape, with selected areas removed, is then engaged against the printing form.

The method and system has the advantage that the rigid and unyielding thermo printing head is faced with a somewhat yielding counter element, so that complete transfer of the thermally affectable material can be ensured. Typically, this is ink-accepting material. This arrangement prevents application of pressure by two stiff rigid elements against each other. Additionally, lower friction and wear ensures a longer lifetime of all operating components.

The system has the additional advantage that transfer of printing information can be carried out with respect to any kind of printing form, even transfer to printing cylinders of large diameters, that is, from between 20 to 40 cm in diameter, even though the printing heads themselves are linear.

In accordance with a feature of the invention, ink-accepting surface areas are transferred in a first method or operating step on the auxiliary transfer element and, in a second operating step, from the auxiliary transfer element to the printing form itself. Additional rollers or cylinders are used which, however, have low accuracy requirements and have to be located only so that one of them backs up the auxiliary transfer element against the thermo transfer element and another then engages the auxiliary transfer element against the printing form. One of these rollers or cylinders can be constructed to be heatable. The intermediate rollers can be made of rubber, or have a rubber coated surface. Thus, a stiff or rigid body is always engaged against an elastic or yieldable body. This substantially reduces wear and friction, and ensures complete transfer of surface areas over the entire axial length of a printing form cylinder, for example.

The auxiliary transfer element, in accordance with a feature of the invention, can be an endless tape or ribbon or belt running over rollers. In accordance with another feature of the invention, and depending on the material and construction of the transfer tape, and preferably for many applications, the tape is spooled off a supply spool, to be wound up on a receiving spool, from where, for example after cleaning, it can be re-used.

It is possible to transfer either that information which is to appear printed; or to transfer the negative thereof, namely the information which is not to be printed, and to leave the other, or remainder, namely that information which is to appear in printed form, on the transfer element. The transfer element, which now will carry a negative, can then be engaged directly against the printing form since all regions which are not to print have been removed therefrom by transfer to the auxiliary transfer element. Preferably, in this form or embodiment of the invention, the auxiliary transfer element is a long tape, ribbon or belt, spooled from a supply reel to a receiving reel.

The actual transfer of ink-accepting surface elements on the printing form can be carried out by a heated roller. That is a simple structural element which can be heated to a higher temperature than that obtainable at thermal printing heads, and which can readily be supplied with higher energy than a thermal printing head, especially an elongated or linear thermo print head. Transfer can be obtained either directly, from remaining thermally affectable material portions on the original thermo transfer element, or from the auxiliary transfer element to which they have been transferred previously.

The heat which is necessary to transfer ink accepting surface elements on the surface of the printing form can be applied in various ways, preferably by a heated engagement roller and/or by heating of the ink-accepting surface elements by means of radiation, or by resistance heating of the transfer element, typically a tape, ribbon or belt. Resistance heating can be obtained, for example, via a metallic layer, for example vapor-deposited on a transfer ribbon or belt, the metallic layer carrying the ink-accepting thermally affectable material.

The roller, whether heated or not, should have an elastic or yieldable surface so that, at any point along its circumference, and in any axially located area, good heat contact is ensured. The diameter of the printing form can be of any selected size, and may be very large, or the printing form can even be flat, that is, diameter infinity.

DRAWINGS

DETAILED DESCRIPTION

Figure 2:
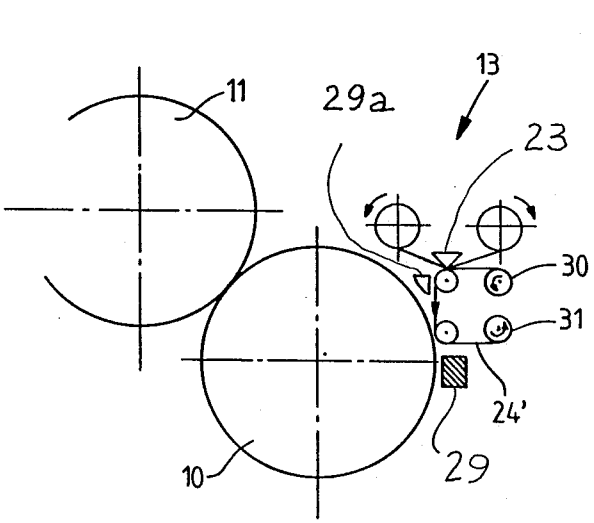
FIG. 2 illustrates a modification in which the auxiliary transfer belt is spooled off a supply reel and on a receiving reel.

The invention will be described with reference to an offset printing machine system, shown only in highly schematic form. Inkers, dampers and other auxiliary apparatus have been omitted from the drawings since they form no part of the invention and they may be of any standard and customary construction.

A cylindrical plate or printing form cylinder 10 is in rolling engagement with a rubber blanket offset cylinder 11. The printing form 10 has an ink rejecting or oleophobic surface which, however, is water-accepting or hydrophilic. A printing system 12 applies printing information on the surface of the plate cylinder 10. The basic construction of the system is the same for all the figures, the only difference being in the system 12, which is shown at respective systems 13, 14 and 15 in FIGS. 2 to 4.

Figure 1:
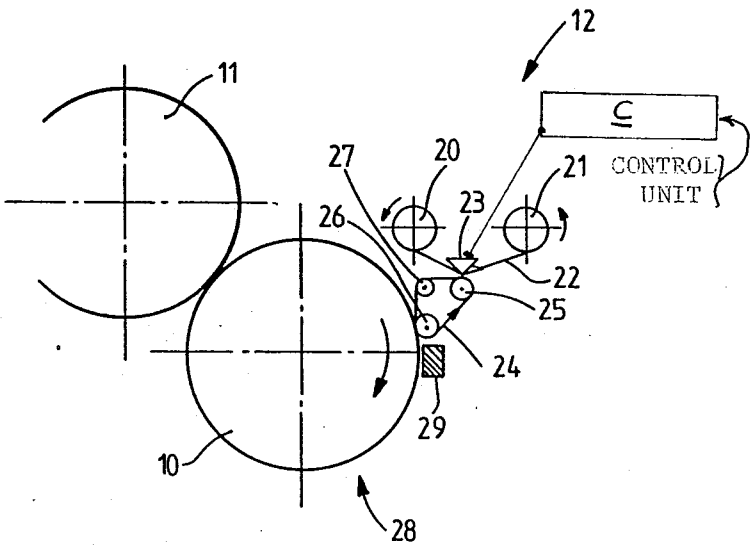
FIG. 1 is a highly schematic side view of a portion of an offset printing machine and illustrating application of printing information on a plate cylinder from an auxiliary endless transfer belt.

Referring to FIG. 1: The image transferring system 12 includes a thermo transfer tape or belt 22, wound off a supply reel 20 and wound on a receiving or take-up reel 21. The thermo transfer belt 22 is engaged by a thermo print head 23 which, in turn, is in engagement with an auxiliary transfer tape, ribbon or belt 24. Belt 24 is an endless belt. The thermo print head 23, for example extending axially across the length of the cylinders 10, 11, is controlled by electrical signals from a control unit shown schematically at C which, in accordance with image information to be transferred, controls individual electrodes or print head elements of the print head 23 in such a way that, for each image point or pixel, heat and pressure is applied against the transfer tape 22 to result in point-by-point transfer of ink-accepting material from a coating on the thermo transfer tape 22 on the auxiliary transfer belt 24. The auxiliary transfer belt 24 is engaged against the print head 23 by a counter roller 25. The counter roller 25 is elastic, for example made of rubber, silicone, or some other suitable elastomer, or at least essentially elastic with a core and a coating or surface region of such elastic material. The auxiliary belt 24 runs about an auxiliary deflection roller 27 and about a further roller 26 which is a heated roller, to place the belt 24 in contact with the surface of the plate cylinder 10. An auxiliary heater 29 can be located just downstream of the pressure roller 26 to ensure tight adhesion of the transferred heat affectable material.

Operation: The transfer belt 22 is spooled off the supply reel 20 onto the take-up reel 21, and, simultaneously, the transfer belt 24 is run, with equal speed, about the counter roller 25 and the heated roller 26. Individual surface regions of heat affectable material are transferred from the transfer tape 22, as commanded by heat control of the respective electrode units of the thermo print head 23, under control of the control unit C. These individually transferred material elements are received by the auxiliary belt 24. These elements are ink-accepting and, upon being conducted between the plate cylinder 10 and the heated roller 26, which is pressure-biassed against the cylinder 10, transfers the surface areas from the auxiliary belt 24 to the surface 28 of the plate cylinder 10. The subsequently, with respect to the direction of rotation, located heat source 29 fixes the surface areas on the surface 28 of the plate cylinder; it is not necessary for many material used, but, for some materials and some thermo transfer tapes, may be desirable. An additional heat source, shown only in FIG. 2 at 29a, may be located in advance of the heated roller 26 to pre-heat the surface 28 of the plate cylinder 10.

The transfer tape 24 should have a material and surface characteristic which permits sharp transfer of material thereto, with clearly defined edges. Thus, the composition of the material and the surface characteristics should match the material of the ink accepting thermo coating on the thermo transfer ribbon or belt 22. Additionally, and this is important for printing machinery, the belt 24 should be longitudinally stable, in order to provide for transfer of surface elements on the printing form 10 while maintaining dimensional relationships of the respective surface elements relative to one another. Suitable materials for the transfer tape 24 are polyesters, polyesters coated with silicone, polyvinyldene fluoride, polyimides, for example the material known under the trade name "Kapton", polytetrafluoroethylene (PTFE), known under the trademark "Teflon", glass fiber-reinforced PTFE foils or belts, and acetate foils. Any one of the foregoing which, preferably, are reinforced, may be coated at one side or both sides with a metallic coating, for example by vapor deposition, or have metal foils applied thereto; further, metal foils or metal tapes with a coating or covering of any one of the above-listed plastic materials may be used.

In the embodiment of FIG. 1, the auxiliary transfer belt 24 is a reuseable endless belt which is carried about the plate cylinder 10 in an endless loop.

FIG. 2 illustrates another embodiment in which the auxiliary belt 24' is supplied from a supply reel 30 and taken up at a take-up reel 31. FIG. 2 also shows the pre-heater head 29a. In all other respects, the print information application system 13 is identical to the system 12.

Figure 3:
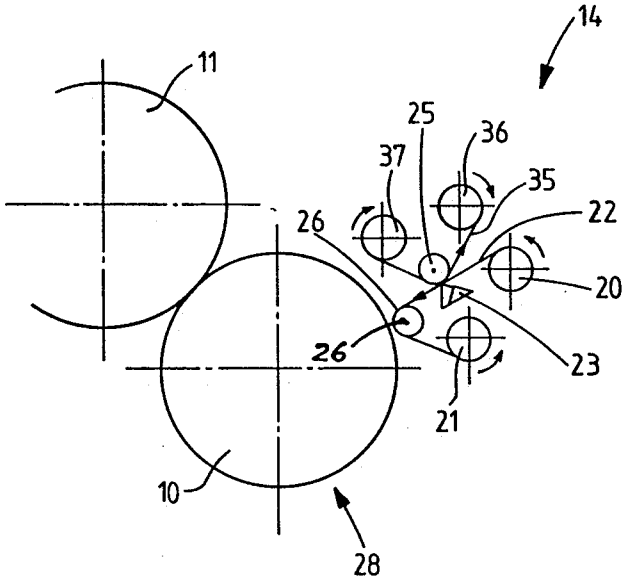
FIG. 3 illustrates another modification in which printing information is applied directly from a thermo transfer tape.

FIG. 3 illustrates another embodiment of the invention in which a system 14 is provided. The thermo transfer belt 22 is spooled from a supply reel 20 in contact with the heated cylinder 26 for transfer of thermally affectable material to the printing cylinder 10, to be then spooled up on the take-up reel 21. Before the thermo transfer tape 22 is run about the heated roller 26, however, the thermo print head 23 acts on the thermally affectable substances thereon, in cooperation with the counter roller 25. The print head 23 is so controlled by the control unit C (not shown in FIG. 3) that those print head units are commanded to melt the thermally affectable material on the belt 22 which do not carry image information, and to thereby transfer that much of the material which is not to print on the auxiliary transfer tape 35. Thus, what will be left on the transfer tape 22 are those surface elements which correspond to the image to be printed. Upon passage of the belt 22 about the heated roller 26, those remaining surface areas, now corresponding to the image to be printed, are transferred to the plate cylinder surface 28. Supply and take-up reels 36, 37 are provided for supplying and, respectively, taking up the auxiliary transfer tape 35. FIG. 3 shows the roller 26 removed from the surface 28 of the plate cylinder 10 for ease of illustration.

Figure 4:
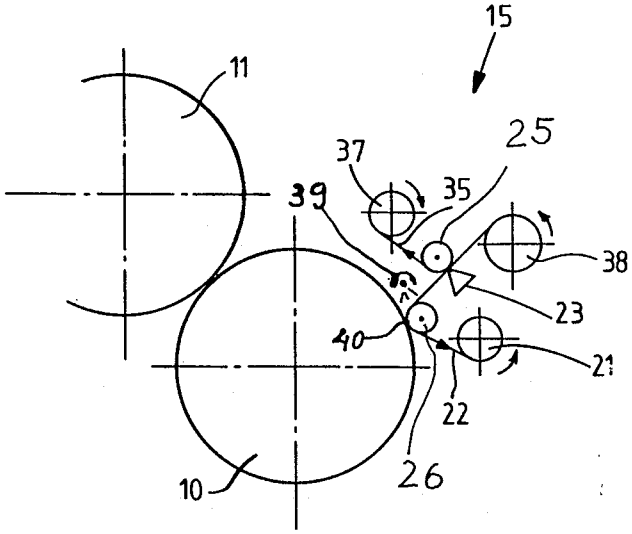
FIG. 4 illustrates another arrangement with direct transfer from a thermo printing tape or belt.

The embodiment of FIG. 4 is similar to that of FIG. 3, except that a common supply reel 38 is provided for the transfer tape 23 and the auxiliary tape 35, both wound together, one above the other, on the reel 38. An additional heat source 39, for example an infrared or similar radiation heater 39, is so placed that the heat rays impinge adjacent the transfer zone 40 on the transfer belt 22 and heat the transfer belt 22. This arrangement can be provided if the roller 26 is not heated, or heated only very little. The heat source 39, of course, can be used in connection with the embodiments of FIGS. 1–3 just as well, in that case applying heat to the auxiliary transfer belt 24, 24'.

Various types of heat sources for transfer of ink-accepting surface elements from the transfer belt or the auxiliary transfer belt on the print form 10 are possible, for example resistance heater, elongated heater elements or the like.

The respective transfer belt may include a resistance element, or the belt may be made of resistance material. Suitably, the resistance material is a vapor-deposited, very thin resistance metal layer on a plastic belt forming a base for the vapor-deposited metal layer. The resistance element can be electrically contacted by a suitable slip contact, brush, or the like, for connection to an electrical energy supply.

The invention has been illustrated in connection with a rotary offset printing machine, but is not limited thereto, and may, equally, be applied to all types of image transfer apparatus, whether operating with cylindrical print forms or flat printing forms or plates.

Various changes and modifications may be made, and any features described herein may be used with any of the others, within the scope of the inventive concept.

We claim:

1. Method of making a planographic printing form (10) comprising the steps of providing a thermo transfer element (22) having ink-accepting surface areas;

providing an auxiliary transfer element (24, 24', 35);

contacting said thermo transfer element and said auxiliary transfer element;

selectively thermally transferring thermally affectable material from said thermo transfer element to the auxiliary transfer element under control of a control unit (C) in accordance with an image to be printed; and transferring said thermally affectable material from one of said elements to said printing form.

2. The method of claim 1, wherein said auxiliary transfer element (24, 24') is a tape, ribbon or belt;

and said step of transferring said thermally affectable material comprises transferring thermally affectable material transferred from the thermo transfer element (22) to the auxiliary transfer element (24, 24') onto the printing form (10) by engaging said auxiliary transfer element against the printing form by a pressure roller (26).

3. The method of claim 2, wherein said step of engaging the tape, ribbon or belt (24, 24') against the printing form (10) comprises heating said roller (26).

4. The method of claim 2, further including the step of providing auxiliary heat to the region where transfer of said thermally affectable material from one of said elements to said printing form (10) occurs.

5. The method of claim 1, wherein the step of selectively thermally transferring thermally affectable material from said thermo transfer element to the auxiliary transfer element comprises transferring those surface areas from the thermo transfer element to the auxiliary transfer element (35) which do not carry printing information;

and wherein said step of transferring said thermally affectable material comprises contacting the thermo transfer element with the printing form (10) and applying heat in the region of contact.

6. The method of claim 5, wherein said contacting step and said heating application step comprises engaging said thermo transfer element at the side remote from said printing form with a heated roller (26).

7. A system to provide ink-accepting and ink-rejecting surface areas on a planographic printing form (10) comprising a thermo transfer element (22);

means (23, C) including a thermo printing head (23) for applying image carrying information to said thermo transfer element;

an auxiliary transfer element (24, 24', 35);

means (25, 27) for engaging said auxiliary transfer element against the printing head, with said thermo transfer element (22) interposed, to transfer thermally affectable material from the thermo transfer element (22) onto the auxiliary transfer element (24, 24', 35) in accordance with image information, and in accordance with selective energization of the thermo printing head (23); and an engagement roller (26) contacting one of said transfer elements against the printing form (10) for transferring thermally affectable material from the respective transfer element onto printing form.

8. The system of claim 7, wherein said engagement roller (26) is a heated roller.

9. The system of claim 7, wherein heating means (39) are provided heating at least one of said transfer elements.

10. The system of claim 7, including heating means located in the vicinity of said engagement roller to heat the region of transfer of said thermally affectable material from the respective transfer element onto the printing form (10).

11. The system of claim 7, including radiant heating means (39) to heat at least one of said transfer elements (24, 24', 35).

12. The system of claim 7, wherein at least one of said transfer elements (24, 24', 35) comprises a tape, ribbon or belt means of insulating material and having a layer or coating of resistive material thereon for resistive heating of the respective tape, ribbon or belt.

13. The system of claim 7, wherein said means for engaging the auxiliary transfer element against the thermo printing head (23), with the thermo transfer element interposed, comprises a roller (25) having a yielding surface, to provide a counter surface for said thermo transfer head (23) which is yielding or compressible.

14. The system of claim 7, wherein said auxiliary transfer element (24, 24', 35) comprises a tape, ribbon or belt of transversely yielding elastic, but longitudinally dimensionally stable material.

* * * * *